US008516869B2

(12) United States Patent
Felkl

(10) Patent No.: US 8,516,869 B2
(45) Date of Patent: Aug. 27, 2013

(54) OPERATING METHOD FOR A COLD-ROLLING LINE TRAIN WITH IMPROVED DYNAMICS

(75) Inventor: Hans-Joachim Felkl, Forchheim (DE)

(73) Assignee: Siemens Aktiengesellschaft, Munich (DE)

( * ) Notice: Subject to any disclaimer, the term of this patent is extended or adjusted under 35 U.S.C. 154(b) by 444 days.

(21) Appl. No.: 12/920,508

(22) PCT Filed: Mar. 9, 2009

(86) PCT No.: PCT/EP2009/052697

§ 371 (c)(1),
(2), (4) Date: Sep. 1, 2010

(87) PCT Pub. No.: WO2009/112443

PCT Pub. Date: Sep. 17, 2009

(65) Prior Publication Data

US 2011/0011143 A1 Jan. 20, 2011

(30) Foreign Application Priority Data

Mar. 14, 2008 (DE) ..... 10 2008 014 304

(51) Int. Cl.
*B21B 23/00* (2006.01)
*B21B 37/00* (2006.01)
*B21B 37/58* (2006.01)

(52) U.S. Cl.
USPC ..... 72/365.2; 72/8.3; 72/9.2; 72/10.3; 72/11.8

(58) Field of Classification Search
USPC ..... 72/8.1, 8.3, 9.2, 10.3, 10.4, 10.7, 72/11.1, 11.2, 11.8, 14.1, 365.2; 700/151, 700/155
See application file for complete search history.

(56) References Cited

U.S. PATENT DOCUMENTS

| | | | | |
|---|---|---|---|---|
| 4,691,547 | A * | 9/1987 | Teoh et al. | 72/10.7 |
| 4,907,434 | A | 3/1990 | Hoshino et al. | 72/8 |
| 5,461,894 | A * | 10/1995 | Sorgel | 72/9.2 |
| 5,495,735 | A * | 3/1996 | Nishimura | 72/11.8 |
| 2009/0031776 | A1 | 2/2009 | Karam et al. | 72/10.7 |
| 2011/0011143 | A1 | 1/2011 | Felkl | 72/8.3 |

FOREIGN PATENT DOCUMENTS

| | | |
|---|---|---|
| DE | 3834059 | 7/1989 |
| DE | 3821280 | 12/1989 |
| DE | 4243045 | 7/1993 |
| DE | 4410960 | 11/1995 |
| DE | 19834758 | 2/2000 |
| GB | 1262742 | 2/1972 |

(Continued)

*Primary Examiner* — Teresa M Ekiert
(74) *Attorney, Agent, or Firm* — King & Spalding L.L.P.

(57) ABSTRACT

In a multi-staged cold-rolling line, a strip is rolled. An actual rolling force of a last rolling stage of the cold-rolling line is detected and fed to a force control unit which determines a control parameter using the actual rolling force and a target rolling force and outputs a control parameter. An actual thickness is detected directly downstream of the last rolling stage and is sent to a thickness control unit which acts on the last rolling stage. Another actual strip thickness is detected directly upstream of the last rolling stage. Enter and exit speeds of the last rolling stage are detected and with a predetermined final strip thickness following the last rolling stage fed to a setpoint determination unit which determines a target thickness which is used as a setpoint for another thickness control unitacting on the next to last rolling stage and receiving the other actual thickness value.

20 Claims, 4 Drawing Sheets

(56) References Cited

FOREIGN PATENT DOCUMENTS

| | | | |
|---|---|---|---|
| JP | 8090028 | | 4/1996 |
| SU | 1202650 | A1 | 1/1986 |
| WO | 2006136670 | | 12/2006 |
| WO | 2009/112443 | A1 | 9/2009 |

* cited by examiner

OPERATING METHOD FOR A COLD-ROLLING LINE TRAIN WITH IMPROVED DYNAMICS

CROSS-REFERENCE TO RELATED APPLICATIONS

This application is a U.S. National Stage Application of International Application No. PCT/EP2009/052697 filed Mar. 9, 2009, which designates the United States of America, and claims priority to DE Application No. 10 2008 014 304.9 filed Mar. 14, 2008. The contents of which are hereby incorporated by reference in their entirety.

TECHNICAL FIELD

The present invention relates to an operating method for a multi-stand cold-rolling mill train for rolling a strip,

- wherein an actual rolling force of a last rolling stand of the rolling mill train is detected and fed to a force controlling device by means of a rolling force detection device,
- wherein the force controlling device determines at least one manipulated variable on the basis of the actual rolling force fed thereto and a desired rolling force, and outputs said variable,
- wherein an actual thickness of the strip is detected and fed to a thickness controlling device by means of a thickness measuring device arranged immediately downstream from the last rolling stand of the rolling mill train,
- wherein the thickness controlling device acts on the last rolling stand of the cold-rolling mill train.

Furthermore, the present invention relates to a computer program, the computer program comprising machine code which can be executed directly by a control device for a multi-stand cold-rolling mill train.

Furthermore, the present invention relates to a data storage medium, on which a computer program of the type described above is stored in machine-readable form.

Furthermore, the present invention relates to a control device for a multi-stand cold-rolling mill train, wherein the control device is programmed with such a computer program. Finally, the present invention relates to a multi-stand rolling mill train, —wherein the cold-rolling mill train has a plurality of rolling stands through which a strip passes in succession during operation of the cold-rolling mill train,

- wherein a rolling force detection device is assigned to the last rolling stand of the cold-rolling mill train and can be used to detect an actual rolling force of the last rolling stand,
- wherein a thickness measuring device, which can be used to detect an actual thickness of the strip, is arranged immediately downstream from the last rolling stand of the cold-rolling mill train, and
- wherein the cold-rolling mill train has a control device of the type described above, and this control device is connected to the rolling stands of the cold-rolling mill train, to the rolling force detection device and to the thickness measuring device by a data link.

BACKGROUND

The subjects described above are generally known. Purely by way of example, reference is made to DE 42 43 045 A1 and JP 08 090 028 A.

In the case of multi-stand cold-rolling mills, the strip thickness is usually measured downstream from the first rolling stand and downstream from the last rolling stand of the cold-rolling mill train. Strip thickness defects which arise in the intermediate rolling stands of the cold-rolling mill train are not detected until the thickness measurement is carried out downstream from the last rolling stand of the cold-rolling mill train. Owing to the principles involved, the outlet-side monitoring of the cold-rolling mill train, which entails dead times, is only able to eliminate these defects incompletely. The elimination of the thickness defects is particularly difficult in so-called mode C, in which the last rolling stand of the cold-rolling mill train is operated as a skin-pass stand with a constant rolling force. The reason for this is that the monitoring acts on the last rolling stand for which the roll nip is controlled, i.e. on the penultimate rolling stand of the cold-rolling mill train. The dead time thus comprises the time which the strip needs in order to be transported from the penultimate rolling stand of the rolling mill train to the thickness measuring device. As a result, only very poor control dynamics are achievable. As already mentioned, in skin-pass mode C the last rolling stand of the multi-stand cold-rolling mill train is operated with a constant rolling force. For this purpose, the last rolling stand is screwed down with a controlled force. On account of the rolling force control, the last rolling stand reacts to thickness defects of the strip by correspondingly yielding. The strip thickness defects thus pass through the last rolling stand of the cold-rolling mill train undiminished. If required, the outlet-side monitoring, i.e. the thickness measuring device downstream from the cold-rolling mill train, changes the pass reduction of the penultimate rolling stand of the cold-rolling mill train. On account of the large amount of dead time between the control intervention on the penultimate rolling stand of the cold-rolling mill train and the subsequent measurement by means of the thickness measuring device, however, it is only possible to sufficiently eliminate infrequent defects.

SUMMARY

According to various embodiments, possible ways of eliminating thickness defects in the rolled strip with improved dynamics can be provided.

According to an embodiment, in an operating method for a multi-stand cold-rolling mill train for rolling a strip, an actual rolling force of a last rolling stand of the cold-rolling mill train is detected and fed to a force controlling device by means of a rolling force detection device, the force controlling device determines at least one manipulated variable on the basis of the actual rolling force fed thereto and a desired rolling force, and outputs said variable, an actual thickness of the strip is detected and fed to a thickness controlling device by means of a thickness measuring device arranged immediately downstream from the last rolling stand of the cold-rolling mill train, the thickness controlling device acts on the last rolling stand of the cold-rolling mill train, a further actual thickness of the strip is detected by means of a further thickness measuring device arranged immediately upstream from the last rolling stand of the cold-rolling mill train, speed detection devices are used to detect speeds at which the strip runs into the last rolling stand of the cold-rolling mill train and runs out of the last rolling stand of the cold-rolling mill train, the detected speeds and a predetermined final thickness, which the strip should have downstream from the last rolling stand of the cold-rolling mill train, are fed to a setpoint value determination device, the setpoint value determination device determines a desired thickness as a function of the variables fed thereto, and a further thickness controlling device acting on the penultimate rolling stand of the cold-rolling mill train is fed the desired thickness as a setpoint value and the further actual thickness as an actual value.

According to a further embodiment, the thickness controlling device may determine a setpoint value for an adjustment device for the roll nip of the last rolling stand of the cold-rolling mill train and feeds it as a setpoint value to a roll nip controlling device, an adjustment distance of the adjustment device may also be fed as an actual value to the roll nip controlling device, the roll nip controlling device may determine an adjustment command for adjusting the adjustment device on the basis of the variables (s, s*, δs1*, δs2*) fed thereto, and outputs said command to the adjustment device, and the thickness controlling device may determine a manipulated variable for the rolling speed of the last rolling stand of the cold-rolling mill train and outputs it to the last rolling stand of the cold-rolling mill train. According to a further embodiment, an eccentricity compensation value may also be fed as an additional setpoint value to the roll nip controlling device. According to a further embodiment, the manipulated variable output by the force controlling device can be fed as an additional setpoint value to the roll nip controlling device. According to a further embodiment, a strip tension prevailing in the strip between the last rolling stand and the penultimate rolling stand of the cold-rolling mill train can be detected and controlled to a desired tension by means of a tension controlling device. According to a further embodiment, the tension controlling device may act on the rolling speed of the last rolling stand or of the penultimate rolling stand of the cold-rolling mill train or on the roll nip controlling device. According to a further embodiment, the manipulated variable output by the force controlling device may act on the rolling speed of the penultimate rolling stand of the cold-rolling mill train, a strip tension prevailing in the strip between the last rolling stand and the penultimate rolling stand of the cold-rolling mill train can be detected and controlled to a desired tension by means of a tension controlling device, and the tension controlling device may act on the roll nip controlling device. According to a further embodiment, the actual thickness can also be fed to the setpoint value determination device, and the setpoint value determination device may take the actual thickness into account when determining the desired thickness. According to a further embodiment, the further thickness measuring device may determine the further actual thickness of the strip indirectly on the basis of a speed of the strip detected upstream from the penultimate rolling stand of the cold-rolling mill train, a known corresponding actual thickness of the strip and a detected speed of the strip between the penultimate rolling stand and the last rolling stand of the cold-rolling mill train.

According to another embodiment, a computer program may comprise machine code which can be executed directly by a control device for a multi-stand cold-rolling mill train, the execution of the machine code by the control device having the effect that the control device realizes the controlling devices mentioned above, controls the detection and measuring devices mentioned above and controls the adjustment elements mentioned above, and as a result the control device operates the cold-rolling mill train in accordance with an operating method as mentioned above.

According to yet another embodiment, a data storage medium may store a computer program in machine-readable form.

According to yet another embodiment, a control device for a multi-stand cold-rolling mill train may be programmed with a computer program as mentioned above such that it is able to realize the controlling devices mentioned above, control the detection and measuring devices mentioned above and control the adjustment elements mentioned above, and as a result the control device operates the cold-rolling mill train in accordance with an operating method as mentioned above.

According to yet another embodiment, in a multi-stand cold-rolling mill train, the cold-rolling mill train has a plurality of rolling stands through which a strip passes in succession during operation of the cold-rolling mill train, a rolling force detection device is assigned to the last rolling stand of the cold-rolling mill train and can be used to detect an actual rolling force of the last rolling stand, a thickness measuring device, which can be used to detect an actual thickness of the strip, is arranged immediately downstream from the last rolling stand of the cold-rolling mill train, and the cold-rolling mill train has a control device as described above, and this control device is connected to the rolling stands of the cold-rolling mill train, to the rolling force detection device and to the thickness measuring device by a data link, such that the control device operates the cold-rolling mill train in accordance with an operating method as described above.

BRIEF DESCRIPTION OF THE DRAWINGS

Further advantages and details will become apparent from the following description of exemplary embodiments in combination with the drawings, in which, in outline form.

DETAILED DESCRIPTION

Figure 1:
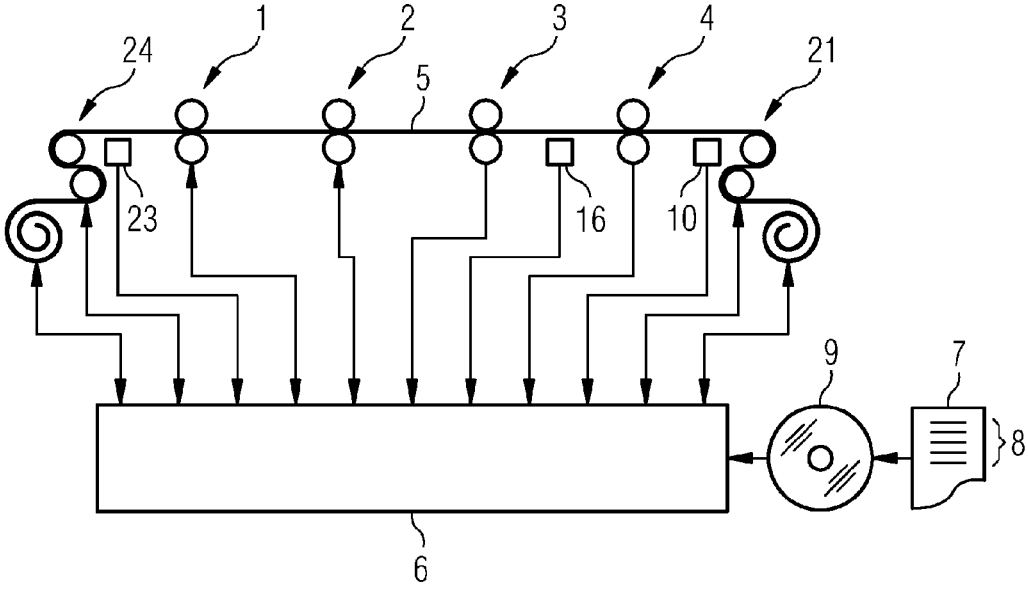
FIG. 1 shows a multi-stand cold-rolling mill train.

In the case of an operating method of the type described above, it is provided according to various embodiments

- that a further actual thickness of the strip is detected by means of a further thickness measuring device arranged immediately upstream from the last rolling stand of the cold-rolling mill train,
- that speed detection devices are used to detect speeds at which the strip runs into the last rolling stand of the cold-rolling mill train and runs out of the last rolling stand of the cold-rolling mill train, —that the detected speeds and a predetermined final thickness, which the strip should have downstream from the last rolling stand of the cold-rolling mill train, are fed to a setpoint value determination device, —that the setpoint value determination device determines a desired thickness as a function of the variables fed thereto, and
- that a further thickness controlling device acting on the penultimate rolling stand of the cold-rolling mill train is fed the desired thickness as a setpoint value and the further actual thickness as an actual value.

An advantageous configuration of various embodiments consists

- in that the thickness controlling device determines a setpoint value for an adjustment device for the roll nip of the last rolling stand of the cold-rolling mill train and feeds it as a setpoint value to a roll nip controlling device,
- in that an adjustment distance of the adjustment device is also fed as an actual value to the roll nip controlling device,
- in that the roll nip controlling device determines an adjustment command for adjusting the adjustment device on the basis of the variables fed thereto, and outputs said command to the adjustment device, and in that the thickness controlling device determines a manipulated variable for the rolling speed of the last rolling stand of the cold-rolling mill train and outputs it to the last rolling stand of the cold-rolling mill train.

An eccentricity compensation value is preferably also fed as an additional setpoint value to the roll nip controlling device. This measure makes it possible to compensate for eccentricity-related strip thickness defects.

It is also preferably provided that the manipulated variable output by the force controlling device is fed as an additional setpoint value to the roll nip controlling device. As a result of this configuration, the force controlling device is superposed on the roll nip controlling device, and as a result the last rolling stand of the cold-rolling mill train is operated directly with a controlled force. Alternatively, it is possible that the manipulated variable output by the force controlling device acts on the rolling speed of the penultimate rolling stand of the cold-rolling mill train, that a strip tension prevailing in the strip between the last rolling stand and the penultimate rolling stand of the cold-rolling mill train is detected and controlled to a desired tension by means of a tension controlling device, and that the tension controlling device acts on the roll nip controlling device.

In this case, the last rolling stand of the cold-rolling mill train is subjected to indirect force control.

According to various embodiments, it is also provided that the actual thickness is also fed to the setpoint value determination device, and that the setpoint value determination device takes the actual thickness into account when determining the desired thickness.

This configuration produces even better control results.

It is possible to configure the further thickness measuring device in a conventional manner. Alternatively, it is possible that the further thickness measuring device determines the further actual thickness of the strip indirectly on the basis of a speed of the strip detected upstream from the penultimate rolling stand of the cold-rolling mill train, a known corresponding actual thickness of the strip and a detected speed of the strip between the penultimate rolling stand and the last rolling stand of the cold-rolling mill train. In terms of programming, the object is also achieved by a computer program in accordance with embodiments. In this case, the computer program comprises machine code which can be executed directly by a control device for a multi-stand cold-rolling mill train. The execution of the machine code by the control device has the effect that the control device realizes the controlling devices mentioned above, controls the detection and measuring devices mentioned above and controls the adjustment elements mentioned above. As a result, the control device operates the cold-rolling mill train in accordance with an operating method of the type described above.

The object is also achieved by a data storage medium, on which a computer program of the type described above is stored in machine-readable form.

In terms of a device, the object is achieved by a control device for a multi-stand cold-rolling mill train, wherein the control device is programmed with a computer program of the type described above. The control device is thereby able to realize the corresponding controlling devices, control the corresponding detection and measuring devices and control the corresponding adjustment elements, and as a result the control device operates the cold-rolling mill train in accordance with an operating method of the type described above.

In terms of a system, the object is achieved by a multi-stand cold-rolling mill train in accordance with embodiments. The multi-stand cold-rolling mill train has a plurality of rolling stands through which a strip passes in succession during operation of the cold-rolling mill train. A rolling force detection device is assigned to the last rolling stand of the cold-rolling mill train and can be used to detect an actual rolling force of the last rolling stand. A thickness measuring device, which can be used to detect an actual thickness of the strip, is arranged immediately downstream from the last rolling stand of the cold-rolling mill train. The cold-rolling mill train has a control device of the type described above, and this control device is connected to the rolling stands of the cold-rolling mill train, to the rolling force detection device and to the thickness measuring device by a data link, such that the control device operates the cold-rolling mill train in accordance with an operating method of the type described above.

According to FIG. 1, a cold-rolling mill train has a plurality of rolling stands 1 to 4 through which a strip 5 passes in succession during operation of the cold-rolling mill train. Purely by way of example, in this case the cold-rolling mill train has four such rolling stands 1 to 4. However, the number of rolling stands 1 to 4 could alternatively also be higher or lower.

The cold-rolling mill train also has a control device 6. The control device 6 is connected to the rolling stands 1 to 4 of the cold-rolling mill train by a data link. The control device 6 operates the cold-rolling mill train in accordance with one of the operating methods which will be explained in more detail below in conjunction with FIGS. 2 to 4. In this respect, within the scope of FIGS. 2 to 4, more details will be provided in particular with respect to the operation of the last rolling stand 4 and the penultimate rolling stand 3 of the cold-rolling mill train. The other rolling stands 1, 2 of the cold-rolling mill train can be operated in a manner known per se. The control device 6 is generally in the form of a programmable control device 6 which, during operation, executes a computer program 7. In this context, the computer program 7 comprises machine code 8 which can be executed directly by the control device 6. In this case, the execution of the machine code 8 has the effect that the control device 6 operates the cold-rolling mill train in accordance with an operating method according to various embodiments.

The computer program 7 may already have been stored in the control device 6 during the production of the control device 6. Alternatively, it is possible to feed the computer program 7 to the control device 6 via a computer-computer link. The computer-computer link in this respect is not shown in FIG. 1. By way of example, it can be in the form of a link to a LAN or to the Internet. In turn, it is alternatively possible to store the computer program 7 on a data storage medium 9 in machine-readable form and to feed the computer program 7 to the control device 6 via the data storage medium 9. The configuration of the data storage medium 9 in this respect is arbitrary. By way of example, it is possible that the data storage medium 9 is in the form of a USB memory stick or a memory card. The data storage medium 9 is shown in the form of a CD-ROM in FIG. 1.

Figure 2:
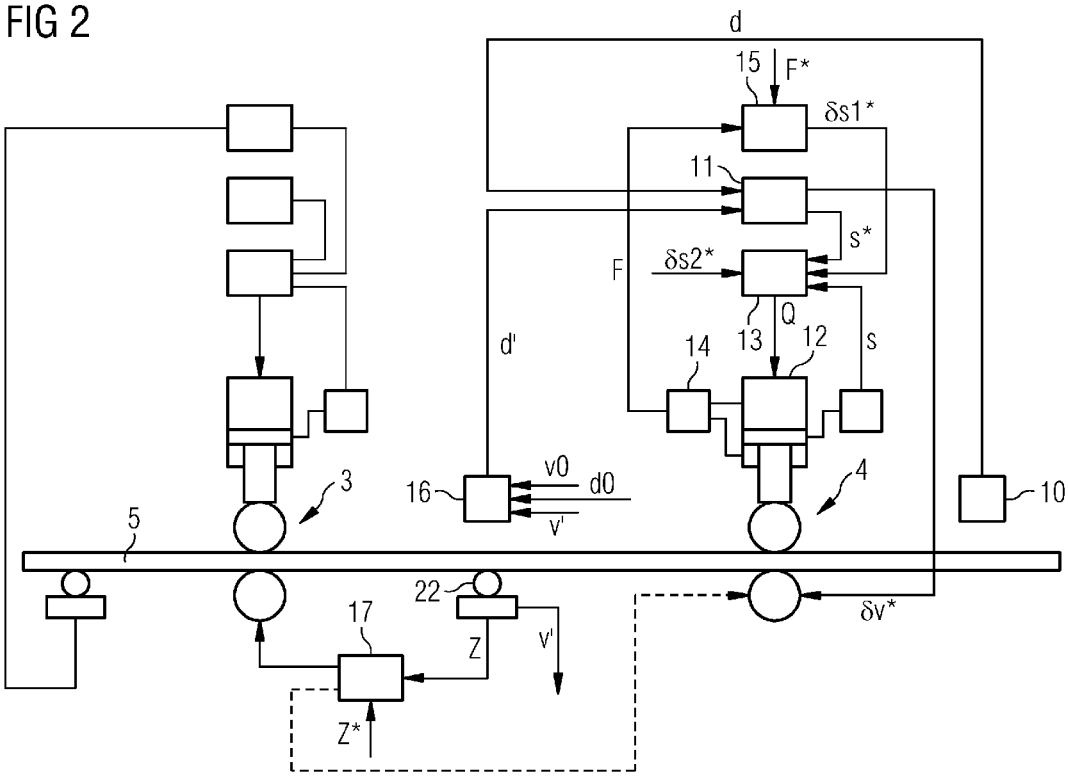
FIG. 2 to 4 show possible configurations of a section of the cold-rolling mill train shown in FIG. 1.

According to FIG. 2, in a first configuration, a thickness measuring device 10 is arranged immediately downstream from the last rolling stand 4 of the cold-rolling mill train. The thickness measuring device 10 is used to detect an actual thickness d of the strip 5 at the site of the thickness measuring device 10. The thickness measuring device 10 feeds the actual thickness d which it has detected to a thickness controlling device 11. The thickness controlling device 11 acts on the last rolling stand 4 of the cold-rolling mill train.

In particular, the thickness controlling device 11 determines a setpoint value s* for an adjustment device 12. The adjustment device 12 can be used to set a roll nip of the last rolling stand 4 of the cold-rolling mill train. The thickness controlling device 11 feeds the determined setpoint value s* as setpoint value s* to a roll nip controlling device 13. An adjustment distance s of the adjustment device 12 is also fed as actual value s to the roll nip controlling device 13. The roll nip controlling device 13 determines an adjustment command Q for adjusting the adjustment device 12 on the basis of the variables s*, s fed thereto. It outputs the adjustment command Q to the adjustment device 12.

According to FIG. 2, the adjustment device 12 is in the form of a hydraulic cylinder device. However, this is not absolutely necessary. All that is important is that the adjustment device 12 can be adjusted under load.

Furthermore, the thickness controlling device 11 determines a further manipulated variable δv*, which acts on the rolling speed of the last rolling stand 4 of the cold-rolling mill train.

According to FIG. 2, a rolling force detection device 14 is also assigned to the last rolling stand 4 of the cold-rolling mill train. An actual rolling force F of the last rolling stand 4 of the cold-rolling mill train is detected and fed to a force controlling device 15 by means of the rolling force detection device 14. The force controlling device 15 determines a manipulated variable δs1* on the basis of the actual rolling force F fed thereto and a desired rolling force F*, and outputs said manipulated variable δs1*. In the exemplary embodiment according to FIG. 2, the manipulated variable δs1* output by the force controlling device 15 is fed as additional setpoint value δs1* to the roll nip controlling device 13.

According to FIG. 2, an eccentricity compensation value δs2* is also fed as further additional setpoint value δs2* to the roll nip controlling device 13. This configuration is preferred, but not absolutely necessary. Owing to the possible configuration of the cold-rolling mill train described above in conjunction with FIG. 2, improved dynamics are achieved, because the thickness controlling device 11 acts dynamically on the last rolling stand 4 of the cold-rolling mill train. This is in contrast with the prior art, in which, although the thickness measuring device 10 is likewise arranged downstream from the last rolling stand 4 of the cold-rolling mill train, the thickness controlling device 11 acts on the penultimate rolling stand 3 of the cold-rolling mill train.

The procedure explained above in conjunction with FIG. 2 can be improved further. In particular, it is possible, according to FIG. 2, that a further thickness measuring device 16 is arranged immediately upstream from the last rolling stand 4 of the cold-rolling mill train. The further thickness measuring device 16 is used to detect a further actual thickness d' of the strip 5 at the site of the further thickness measuring device 16. According to FIG. 2, the further actual thickness d' is likewise fed to the thickness controlling device 11. The thickness controlling device 11 is therefore able to take the further actual thickness d' into account when determining the setpoint value s*. As a result, the manipulated variable S* acting on the last rolling stand 4 of the cold-rolling mill train is therefore varied on the basis of the detected further actual thickness d'. The manipulated variable s* varied on the basis of the further actual thickness d' therefore acts on the roll nip controlling device 13.

According to FIG. 2, a strip tension Z prevailing in the strip 5 between the last rolling stand 4 and the penultimate rolling stand 3 of the cold-rolling mill train is also detected. The strip tension Z and a desired tension Z* are fed to a tension controlling device 17, which controls the strip tension Z to the desired tension Z*. In this case, the tension controlling device 17 can act, in particular, on the rolling speed of the penultimate rolling stand 3 of the cold-rolling mill train. It is alternatively possible, as shown by dashed lines in FIG. 2, that the tension controlling device 17 acts on the rolling speed of the last rolling stand 4 of the cold-rolling mill train. As an alternative to the configuration according to FIG. 2, it is possible to operate the cold-rolling mill train in accordance with an operating method which is explained in more detail below in conjunction with FIG. 3. Within the scope of FIG. 3, details relating to the features in common with the configuration according to FIG. 2 will firstly be discussed, and then the differences will be explained.

Figure 3:
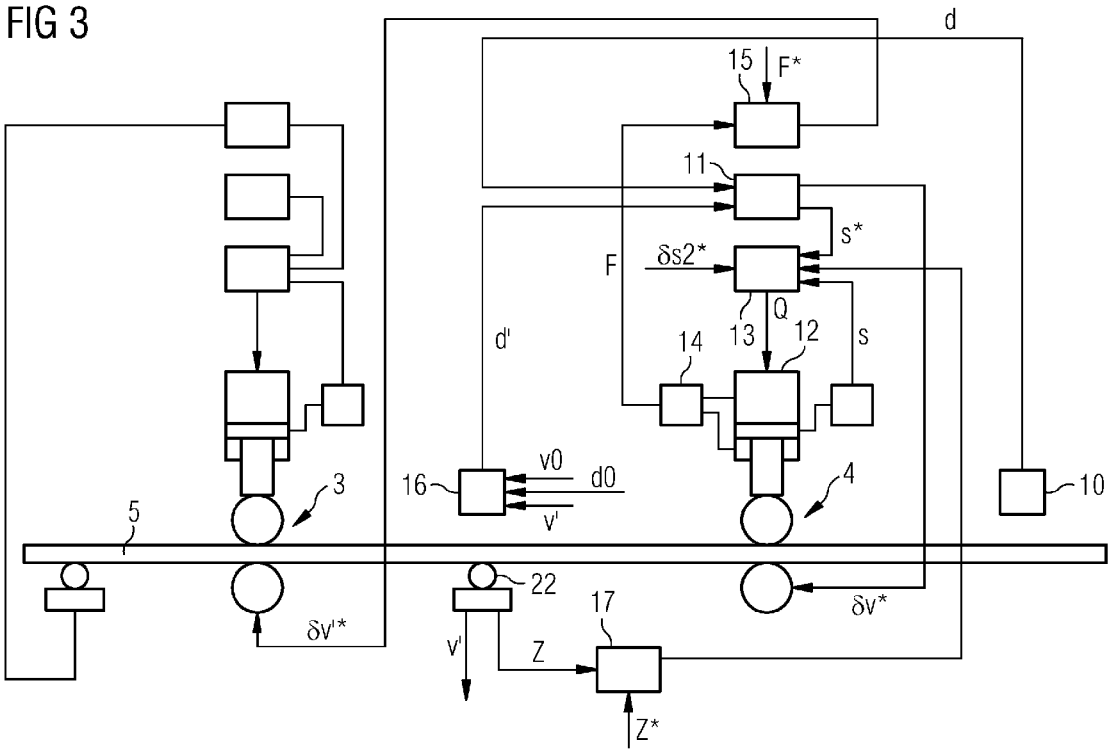

In the configuration according to FIG. 3, too, the thickness measuring device 10 is arranged downstream from the last rolling stand 4 of the cold-rolling mill train. The thickness measuring device 10 detects the actual thickness d of the strip 5 downstream from the last rolling stand 4 of the cold-rolling mill train and feeds the actual thickness d to the thickness controlling device 11. The thickness controlling device 11 acts on the last rolling stand 4 of the cold-rolling mill train.

Furthermore, in the configuration according to FIG. 3, too, the thickness controlling device 11 determines the setpoint value s* for the adjustment device 12 and feeds it as setpoint value s* to the roll nip controlling device 13. The roll nip controlling device 13 receives the setpoint value s* and the corresponding actual value s and, in the same way as that described above, determines the adjustment command Q for adjusting the adjustment device 12. Furthermore, the rolling force detection device 14 is present in the configuration according to FIG. 3, too, and this device detects the actual rolling force F of the last rolling stand 4 and feeds it to the force controlling device 15. As above, the force controlling device 15 determines a manipulated variable δv'* on the basis of the actual rolling force F fed thereto and the desired rolling force F* likewise fed thereto, and outputs said manipulated variable δv'*. In contrast to the configuration according to FIG. 2, however, the manipulated variable δv'*, output by the force controlling device 15 acts on the rolling speed of the penultimate rolling stand 3 of the cold-rolling mill train. Furthermore, it is also provided in the configuration according to FIG. 3 that the thickness controlling device 11 determines a further manipulated variable δv*, which acts on the rolling speed of the last rolling stand 4 of the cold-rolling mill train. Analogously to the configuration according to FIG. 2, the strip tension Z between the last rolling stand 4 and the penultimate rolling stand 3 of the cold-rolling mill train is detected and fed to the tension controlling device 17. The tension controlling device 17 controls the strip tension Z to the desired tension Z*. Furthermore, it is provided in the configuration according to FIG. 3 that the tension controlling device 17 acts on the roll nip controlling device 13.

As a result, the configuration according to FIG. 3 has the same effect as the configuration according to FIG. 2. This is because the thickness controlling device 11 acts on the last rolling stand 4 of the cold-rolling mill train, and so the dead time is reduced and the dynamics are therefore improved.

Various advantageous refinements are also possible in the case of the configuration according to FIG. 3. In particular, it is also possible—analogously to FIG. 2—to feed the eccentricity compensation value δs2* as additional setpoint value δs2* to the roll nip controlling device 13.

Furthermore, it is possible that the further actual thickness d' of the strip 5 is detected and fed to the thickness controlling device 11 by means of the further thickness measuring device 16. In this case, too, the thickness controlling device 11 can vary a manipulated variable s* acting on the last rolling stand 4 of the cold-rolling mill train on the basis of the detected further actual thickness d' of the strip 5.

Furthermore, it is possible to operate the cold-rolling mill train in accordance with an operating method which is explained in more detail below in conjunction with FIG. 4. In this context, the mode of operation according to FIG. 4 is possible as an alternative or in addition to one of the configurations according to FIGS. 2 and 3.

Figure 4:
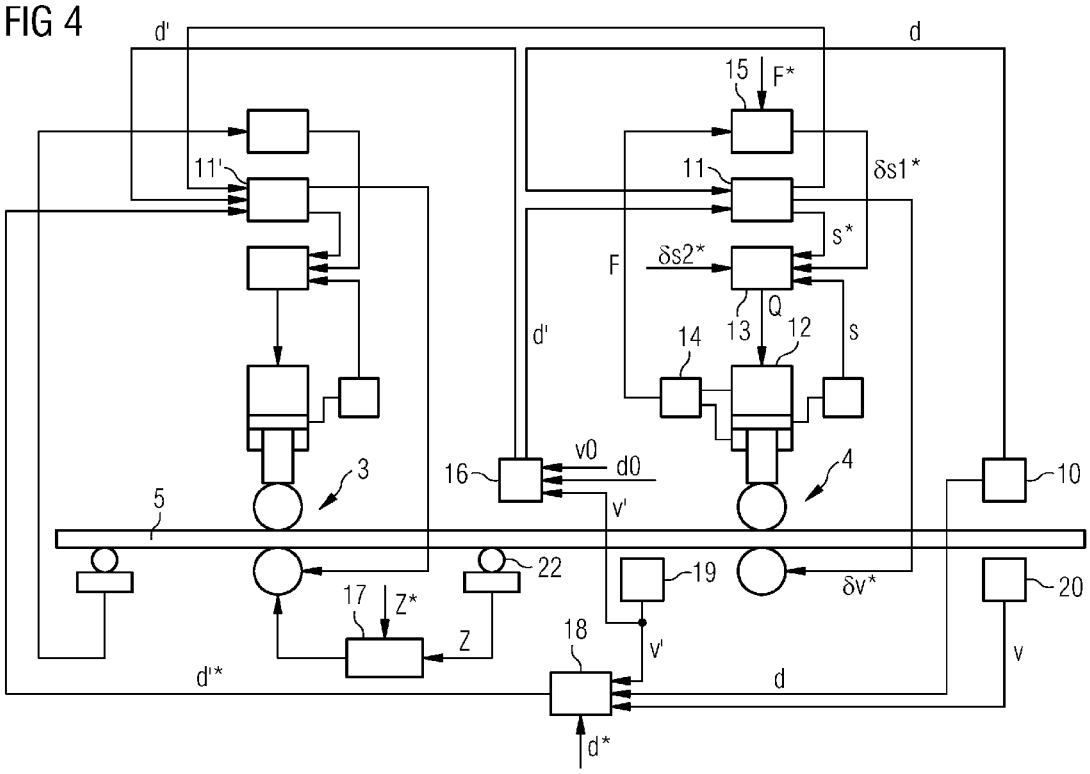

In the configuration according to FIG. 4, too, the thickness measuring device 10 is arranged immediately downstream from the last rolling stand 4 of the cold-rolling mill train. Furthermore, the thickness controlling device 11 is again present, and the actual thickness d of the strip 5 is fed thereto. In the configuration according to FIG. 4, as well, the thickness controlling device 11 acts on the last rolling stand 4 of the cold-rolling mill train. Analogously to the configurations according to FIGS. 2 and 3, the rolling force detection device 14 is present in the configuration according to FIG. 4, and this device detects the actual rolling force F of the last rolling stand 4 and feeds it to the force controlling device 15. The force controlling device 15 determines (as above) a manipulated variable δs1* on the basis of the actual rolling force F fed thereto and a desired rolling force F*, and outputs the manipulated variable δs1*. Analogously to the configuration according to FIG. 2, the manipulated variable δs1* acts on the roll nip controlling device 13.

Furthermore, in the configuration according to FIG. 4, the further actual thickness d' of the strip 5 is detected and fed as actual value d' to a further thickness controlling device 11' by means of the further thickness measuring device 16 arranged immediately upstream from the last rolling stand 4 of the cold-rolling mill train. Here, the further thickness controlling device 11' acts on the penultimate rolling stand 3 of the cold-rolling mill train.

For correct control, the further thickness controlling device 11 requires both the further actual thickness d' and a desired thickness d'*. The desired thickness d'* is determined by means of a setpoint value determination device 18. For this purpose, speed detection devices 19, 20 are present. The speed detection devices 19, 20 are used to detect speeds v', v at which the strip 5 runs into the last rolling stand 4 of the cold-rolling mill train and runs out of the last rolling stand 4 of the cold-rolling mill train. The detected speeds v', v and a final thickness d*, which the strip 5 should have downstream from the last rolling stand 4 of the cold-rolling mill train, are fed to the setpoint value determination device 18. The setpoint value determination device 18 determines the desired thickness d'* as a function of the variables d*, d, v', v fed thereto, and feeds said thickness as setpoint value d'* to the thickness controlling device 11.

The formula for determining the desired thickness d* follows from the continuity equation. This is because the following should apply:

$$d'^{*}\cdot v'=d^{*}\cdot v \tag{1}$$

The speeds v, v' can be determined in different ways. By way of example, it is possible that, according to FIG. 1, a tension bridle 21 is arranged downstream from the last rolling stand 4 and the circumferential speed of the rollers of the tension bridle 21 is detected. This speed v corresponds very well to the outlet-side speed of the strip 5 downstream from the last rolling stand 4. To detect the speed v' of the strip 5 between the last rolling stand 4 and the penultimate rolling stand 3, it is possible, for example, to determine the circumferential speed of a tension measuring roller 22. However, other procedures are alternatively possible.

In the configuration according to FIG. 4, too, the eccentricity compensation value δs2* can also be fed as additional setpoint value δs2* to the roll nip controlling device 13.

Better dynamics can also be achieved in the configuration according to FIG. 4 than in the prior art because, although the further thickness controlling device 11', analogously to the prior art, acts on the penultimate rolling stand 3 of the cold-rolling mill train, the associated thickness measuring device 16, in contrast to the prior art, is not arranged downstream from the last rolling stand 4 of the cold-rolling mill train, but instead upstream from the last rolling stand 4 of the cold-rolling mill train.

As a further configuration of the operating method according to FIG. 4, it is possible to also feed the actual thickness d to the setpoint value determination device 18. In this case, the setpoint value determination device 18 can take the actual thickness d into account when determining the desired thickness d'*. The thickness measuring device 10, by means of which the actual thickness d of the strip 5 downstream from the last rolling stand 4 is determined, is preferably in the form of a conventional thickness measuring device. The further thickness measuring device 16, by means of which the actual thickness d' of the strip 5 between the penultimate rolling stand 3 and the last rolling stand 4 of the cold-rolling mill train is determined, can also have a conventional form. In the text which follows, however, an alternative configuration of this thickness measuring device 16 is explained in conjunction with FIG. 5.

Figure 5:
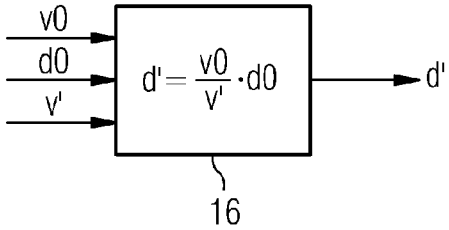
FIG. 5 shows a possible configuration of a thickness measuring device.

According to FIG. 5, the speed v' of the strip 5 between the penultimate rolling stand 3 and the last rolling stand 4 of the cold-rolling mill train is detected. By way of example, the circumferential speed of the tension measuring roller 22 can be detected. Alternatively, by way of example, it is possible to detect the circumferential speed of the rollers of the penultimate rolling stand 3 of the cold-rolling mill train and to determine the speed v' of the strip 5 between the penultimate rolling stand 3 and the last rolling stand 4 of the cold-rolling mill train by taking the forward slip into account.

Furthermore, at a location arranged upstream from the penultimate rolling stand 3—this can alternatively be a location between the penultimate rolling stand 3 and the third-last rolling stand 2 or a location even further away from the penultimate rolling stand 3—a speed v0 of the strip 5 and the strip thickness d0 present at this location are detected and fed to the further thickness measuring device 16. By way of example, an inlet thickness d0 of the strip 5 can be detected by means of an additional thickness measuring device 23 on the inlet side of the cold-rolling mill train. Analogously, a corresponding inlet-side strip speed v0 can be detected on the inlet side of the cold-rolling mill train—for example by detecting the circumferential speed of rollers of an upstream tension bridle 24.

The displacement of the respective locations of the strip 5, for which the inlet thicknesses d0 have been detected, is monitored through the cold-rolling mill train. At the correct point in time, the further actual thickness d' is determined by means of the further thickness measuring device 16. The further actual thickness is determined here on the basis of the following relationship:

$$d'\cdot v'=d0\cdot v0 \tag{2}$$

where v0 and v' are the currently detected speeds. d0 is the initial thickness d0 of the strip 5 which that location of the strip 5 currently running out of the penultimate rolling stand 3 has been detected to have by the additional thickness measuring device 23.

The various controlling devices 11, 11', 13, 15 and 17 and also the setpoint value determination device 18 are generally implemented as software. They are thus parts of the computer program 7. The execution of the computer program 7 by the control device 6 therefore has the effect that the control device 6 realizes the corresponding controlling devices 11, 11', 13, 15 and 17 and the setpoint value determination device 18. Furthermore, owing to the execution of the machine code 8, the control device 6 controls the detection devices 14, 19, 20 and the adjustment elements 12 (and others). As a result, the control device 6 therefore operates the cold-rolling mill train in accordance with one of the operating methods described above. Furthermore, it goes without saying that the control device 6 is also connected to said devices 10, 12, 14, 16, 19, 20, etc. by a data link.

The various embodiments have many advantages. In particular, the contradiction "constant rolling force control at the last rolling stand 4 for skin-pass operation" and "utilization of the actuating action of the screw-down of the last rolling stand 4 for reducing thickness defects", which is considered to be inextricable in the prior art, is overcome according to various embodiments. Both the requirements imposed on skin-pass operation and the requirements imposed on the dimensional stability of the finished strip 5 are taken into consideration. Dynamics previously considered not to be possible compared to the prior art are nevertheless obtained. The above description serves exclusively to explain the present invention. The scope of protection of the present invention should be determined, however, exclusively by the appended claims.

What is claimed is:

1. An operating method for a multi-stand cold-rolling mill train for rolling a strip, comprising:

detecting an actual rolling force of a last rolling stand of the cold-rolling mill train and feeding it to a force controlling device by means of a rolling force detection device, determining by the force controlling device at least one manipulated variable on the basis of the actual rolling force fed thereto and a desired rolling force, and outputting said variable, detecting an actual thickness of the strip and feeding it to a thickness controlling device by means of a thickness measuring device arranged immediately downstream from the last rolling stand of the cold-rolling mill train, wherein the thickness controlling device acts on the last rolling stand of the cold-rolling mill train, detecting a further actual thickness of the strip by means of a further thickness measuring device arranged immediately upstream from the last rolling stand of the cold-rolling mill train, using speed detection devices to detect speeds at which the strip runs into the last rolling stand of the cold-rolling mill train and runs out of the last rolling stand of the cold-rolling mill train, feeding the detected speeds and a predetermined final thickness, which the strip should have downstream from the last rolling stand of the cold-rolling mill train, to a setpoint value determination device, determining by the setpoint value determination device a desired thickness as a function of the variables fed thereto, and feeding the desired thickness as a setpoint value and the further actual thickness as an actual value to a further thickness controlling device acting on the penultimate rolling stand of the cold-rolling mill train.

2. The operating method according to claim 1, further comprising:

the thickness controlling device determining a setpoint value for an adjustment device for the roll nip of the last rolling stand of the cold-rolling mill train and feeding the setpoint value to a roll nip controlling device, the adjustment device feeding an adjustment distance as an actual value to the roll nip controlling device, the roll nip controlling device determining an adjustment command for adjusting the adjustment device on the basis of the variables fed thereto, and outputting said command to the adjustment device, and the thickness controlling device determining a manipulated variable for the rolling speed of the last rolling stand of the cold-rolling mill train and outputting it to the last rolling stand of the cold-rolling mill train.

3. The operating method according to claim 2, further comprising feeding an eccentricity compensation value as an additional setpoint value to the roll nip controlling device.

4. The operating method according to claim 2, further comprising feeding the manipulated variable output as an additional setpoint value to the roll nip controlling device.

5. The operating method according to claim 4, further comprising a tension controlling device detecting and controlling to a desired tension a strip tension prevailing in the strip between the last rolling stand and the penultimate rolling stand of the cold-rolling mill train.

6. The operating method according to claim 5, further comprising the tension controlling device acting on the rolling speed of the last rolling stand or of the penultimate rolling stand of the cold-rolling mill train or on the roll nip controlling device.

7. The operating method according to claim 2, further comprising the manipulated variable output by the force controlling device acting on the rolling speed of the penultimate rolling stand of the cold-rolling mill train, a tension controlling device detecting and controlling to a desired tension a strip tension prevailing in the strip between the last rolling stand and the penultimate rolling stand of the cold-rolling mill train, and the tension controlling device acting on the roll nip controlling device.

8. The operating method according to claim 1, further comprising feeding the actual thickness to the setpoint value determination device, and the setpoint value determination device taking the actual thickness into account when determining the desired thickness.

9. The operating method according to claim 1, further comprising the further thickness measuring device determining the further actual thickness of the strip indirectly on the basis of a speed of the strip detected upstream from the penultimate rolling stand of the cold-rolling mill train, a known corresponding actual thickness of the strip and a detected speed of the strip between the penultimate rolling stand and the last rolling stand of the cold-rolling mill train.

10. A computer program product comprising a non-transitory data storage medium storing machine code which can be executed directly by a control device for a multi-stand cold-rolling mill train, the execution of the machine code by the control device performs a method comprising:

detecting an actual rolling force of a last rolling stand of the cold-rolling mill train and feeding it to a force controlling device by means of a rolling force detection device, determining by the force controlling device at least one manipulated variable on the basis of the actual rolling force fed thereto and a desired rolling force, and outputting said variable, detecting an actual thickness of the strip and feeding it to a thickness controlling device by means of a thickness measuring device arranged immediately downstream from the last rolling stand of the cold-rolling mill train, wherein the thickness controlling device acts on the last rolling stand of the cold-rolling mill train, detecting a further actual thickness of the strip by means of a further thickness measuring device arranged immediately upstream from the last rolling stand of the cold-rolling mill train, using speed detection devices to detect speeds at which the strip runs into the last rolling stand of the cold-rolling mill train and runs out of the last rolling stand of the cold-rolling mill train, feeding the detected speeds and a predetermined final thickness, which the strip should have downstream from the last rolling stand of the cold-rolling mill train, to a setpoint value determination device, determining by the setpoint value determination device a desired thickness as a function of the variables fed thereto, and feeding the desired thickness as a setpoint value and the further actual thickness as an actual value to a further thickness controlling device acting on the penultimate rolling stand of the cold-rolling mill train.

11. The computer program product of claim 10, wherein upon execution by the control device:

the thickness controlling device determines a setpoint value for an adjustment device for the roll nip of the last rolling stand of the cold-rolling mill train and feeds it as a setpoint value to a roll nip controlling device, an adjustment distance of the adjustment device is also fed as an actual value to the roll nip controlling device, the roll nip controlling device determines an adjustment command for adjusting the adjustment device on the basis of the variables fed thereto, and outputs said command to the adjustment device, and the thickness controlling device determines a manipulated variable for the rolling speed of the last rolling stand of the cold-rolling mill train and outputs it to the last rolling stand of the cold-rolling mill train.

12. A control device for a multi-stand cold-rolling mill train, wherein the control device is programmed with a computer program according to claim 11.

13. A multi-stand cold-rolling mill train, comprising:

a plurality of rolling stands through which a strip passes in succession during operation of the cold-rolling mill train, a rolling force detection device assigned to the last rolling stand of the cold-rolling mill train configured to be used to detect an actual rolling force of the last rolling stand, a thickness measuring device configured to detect an actual thickness of the strip arranged immediately downstream from the last rolling stand of the cold-rolling mill train, and wherein the cold-rolling mill train is configured to detect an actual rolling force of the last rolling stand of the cold-rolling mill train and to feed it to a force controlling device by means of the rolling force detection device, determine by the force controlling device at least one manipulated variable on the basis of the actual rolling force fed thereto and a desired rolling force, and outputting said variable, detect an actual thickness of the strip and to feed it to a thickness controlling device by means of a thickness measuring device arranged immediately downstream from the last rolling stand of the cold-rolling mill train, wherein the thickness controlling device acts on the last rolling stand of the cold-rolling mill train, detect a further actual thickness of the strip by means of a further thickness measuring device arranged immediately upstream from the last rolling stand of the cold-rolling mill train, and further comprising speed detection devices to detect speeds at which the strip runs into the last rolling stand of the cold-rolling mill train and runs out of the last rolling stand of the cold-rolling mill train, wherein the detected speeds and a predetermined final thickness, which the strip should have downstream from the last rolling stand of the cold-rolling mill train, are fed to a setpoint value determination device, and wherein the setpoint value determination device is operable to determine a desired thickness as a function of the variables fed thereto, and the desired thickness is fed as a setpoint value and the further actual thickness is fed as an actual value to a further thickness controlling device acting on the penultimate rolling stand of the cold-rolling mill train.

14. The multi-stand cold-rolling mill train according to claim 13, wherein the thickness controlling device is configured to determine a setpoint value for an adjustment device for the roll nip of the last rolling stand of the cold-rolling mill train and feeds it as a setpoint value to a roll nip controlling device, the adjustment device feeds an adjustment distance as an actual value to the roll nip controlling device, the roll nip controlling device is configured to determine an adjustment command for adjusting the adjustment device on the basis of the variables fed thereto, and to output said command to the adjustment device, and the thickness controlling device is configured to determine a manipulated variable for the rolling speed of the last rolling stand of the cold-rolling mill train and to output it to the last rolling stand of the cold-rolling mill train.

15. The multi-stand cold-rolling mill train according to claim 14, wherein the roll nip controlling device is configured to receive an eccentricity compensation value as an additional setpoint value.

16. The multi-stand cold-rolling mill train according to claim 14, wherein the roll nip controlling device is configured to receive the manipulated variable output by the force controlling device as an additional setpoint value.

17. The multi-stand cold-rolling mill train according to claim 16, wherein a strip tension prevailing in the strip between the last rolling stand and the penultimate rolling stand of the cold-rolling mill train is detected and controlled to a desired tension by means of a tension controlling device.

18. The multi-stand cold-rolling mill train according to claim 17, wherein the tension controlling device is configured to act on the rolling speed of the last rolling stand or of the penultimate rolling stand of the cold-rolling mill train or on the roll nip controlling device.

19. The multi-stand cold-rolling mill train according to claim 14, further comprising:

a tension controlling device configured to detect a strip tension prevailing in the strip between the last rolling stand and the penultimate rolling stand of the cold-rolling mill train and to control it to a desired tension, the tension controlling device is configured to act on the roll nip controlling device.

20. The multi-stand cold-rolling mill train according to claim 13, wherein the setpoint value determination device is configured to receive the actual thickness, and the setpoint value determination device is configured to take the actual thickness into account when determining the desired thickness.

* * * * *